US011339496B2

(12) United States Patent
Hirao

(10) Patent No.: US 11,339,496 B2
(45) Date of Patent: May 24, 2022

(54) PLATING APPARATUS

(71) Applicant: EBARA CORPORATION, Tokyo (JP)

(72) Inventor: Tomonori Hirao, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 16/890,780

(22) Filed: Jun. 2, 2020

(65) Prior Publication Data

US 2020/0392641 A1 Dec. 17, 2020

(30) Foreign Application Priority Data

Jun. 13, 2019 (JP) ..... JP2019-110430

(51) Int. Cl.

| | |
|---|---|
| ***C25D 17/06*** | (2006.01) |
| ***C25D 17/00*** | (2006.01) |
| ***C25D 17/02*** | (2006.01) |
| ***C25D 5/02*** | (2006.01) |

(52) U.S. Cl.

CPC ..... *C25D 17/06* (2013.01); *C25D 5/028* (2013.01); *C25D 17/004* (2013.01); *C25D 17/02* (2013.01); *C25D 17/001* (2013.01)

(58) Field of Classification Search

None

See application file for complete search history.

(56) References Cited

U.S. PATENT DOCUMENTS

2002/0195352 A1* 12/2002 Mayer ..... C25D 17/12 205/687
2009/0139871 A1* 6/2009 Saito ..... C25D 21/12 205/148
2016/0108539 A1 4/2016 Yahagi et al.
2016/0194780 A1* 7/2016 Nagai ..... H01L 21/2885 204/242
2016/0230285 A1* 8/2016 Yamamoto ..... C23C 18/163
2016/0258080 A1* 9/2016 Kimura ..... C25D 17/08

FOREIGN PATENT DOCUMENTS

JP 2016-079504 A 5/2016

* cited by examiner

*Primary Examiner* — Louis J Rufo
(74) *Attorney, Agent, or Firm* — BakerHostetler

(57) ABSTRACT

There is provided a shielding plate that adjusts an electric potential distribution on a substrate near the substrate. According to one embodiment, there is provided a plating apparatus for performing a plating process on the substrate. The plating apparatus includes a substrate holder, the shielding plate, and a moving mechanism. The substrate holder holds the substrate. The shielding plate is disposed adjacent to the substrate holder. The moving mechanism moves the shielding plate in a direction of approaching the substrate holder and a direction away from the substrate holder. The shielding plate is moved to the substrate holder by the moving mechanism to be contactable with the substrate holder.

6 Claims, 7 Drawing Sheets

PLATING APPARATUS

CROSS-REFERENCE TO RELATED APPLICATION

This application is based upon and claims the benefit of priority of the prior Japanese Patent Application No. 2019-110430, filed on Jun. 13, 2019, the entire content of which is incorporated herein by reference.

TECHNICAL FIELD

This application relates to a plating apparatus.

BACKGROUND ART

Formation of a metal plating film, such as Cu, on a surface of a semiconductor device and a substrate for electronic element has been performed. For example, there may be a case where a substrate as a plating object is held to a substrate holder and the substrate is immersed in a plating tank housing a plating solution together with the substrate holder for electroplating. The substrate holder holds the substrate so as to expose a plating surface of the substrate. In the plating solution, an anode is disposed corresponding to the exposed surface of the substrate and a voltage is given between the substrate and the anode, thus ensuring forming an electroplating film on the exposed surface of the substrate.

CITATION LIST

Patent Literature

PTL 1: Japanese Unexamined Patent Application Publication No. 2016-79504

SUMMARY OF INVENTION

Technical Problem

To uniformly perform the plating process on the substrate, some electroplating apparatuses include a shielding plate (also referred to as a regulation plate) to adjust an electric potential distribution on the substrate. The shielding plate is disposed between the anode and the substrate and has an opening to permit a current flowing from the anode to the substrate to pass through. To adjust the electric potential distribution near the outer periphery of the substrate, disposing the shielding plate extremely close to the substrate is desired in some cases. In the case where the shielding plate is disposed extremely close to the substrate, when the substrate holder holding the substrate is disposed in the plating tank, the substrate holder possibly collides with the shielding plate.

Therefore, a substrate holder that does not dispose a shielding plate extremely close to the substrate holder and has a function as a shielding plate has been developed. For example, PTL 1 discloses a substrate holder including a regulation ring to adjust an electric field between an anode and a substrate. Since the substrate holder includes the regulation ring projecting out in a flange shape near an outer periphery of a front surface of the substrate, the electric field extremely close to the substrate can be adjusted. However, the regulation ring has the structure of projecting out to the front surface of the substrate, and therefore the substrate holder has an intricated, complex mechanical shape. Therefore, when the substrate holder is immersed in a plating solution in a plating tank, air and air bubble possibly remain in the substrate holder and between the regulation ring and the substrate, and this causes a risk of giving a negative effect on uniform plating of the substrate. Additionally, when the substrate holder is pulled out of the plating tank, the plating solution remains in the substrate holder and between the regulation ring and the substrate in some cases. One object of this application is to solve or reduce at least some of the problems.

Solution to Problem

According to one embodiment, there is provided a plating apparatus for performing a plating process on a substrate. The plating apparatus includes a substrate holder, a shielding plate, and a moving mechanism. The substrate holder holds the substrate. The shielding plate is disposed adjacent to the substrate holder. The moving mechanism moves the shielding plate in a direction of approaching the substrate holder and a direction away from the substrate holder. The shielding plate is moved to the substrate holder by the moving mechanism to be contactable with the substrate holder.

DESCRIPTION OF EMBODIMENTS

Figure 1:
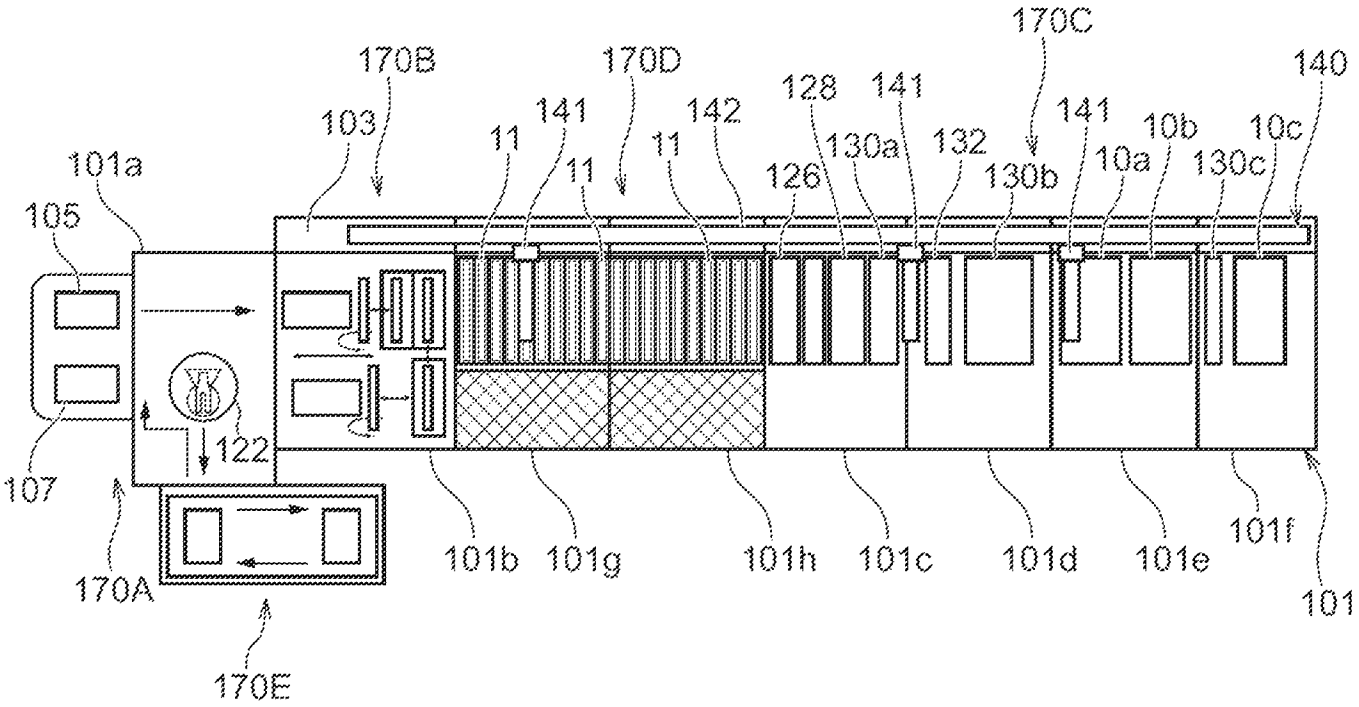
FIG. 1 is a schematic diagram illustrating a plating apparatus according to one embodiment.

The following describes embodiments of a plating apparatus according to the present invention with reference to the attached drawings. In the attached drawings, identical or similar reference numerals are attached to identical or similar components, and overlapping description regarding the identical or similar components may be omitted in the description of the respective embodiments. Features illustrated in the respective embodiments are applicable to other embodiments in so far as they are consistent with one another.

FIG. 1 is a schematic diagram illustrating the plating apparatus according to one embodiment. As illustrated in FIG. 1, the plating apparatus includes a base 101, a controller 103 that controls an operation of the plating apparatus, a loader/unloader 170A where a substrate W (see FIG. 2) is loaded and unloaded, a substrate setter (mechanical chamber) 170E where the substrate W is set to a substrate holder 11 (see FIG. 2) and the substrate W is removed from the substrate holder 11, a processing portion (pretreatment chamber, plating chamber) 170C where the substrate W is plated, a holder storage (stocker chamber) 170D where the substrate holder 11 is stored, and a cleaner 170E where the plated substrate W is cleaned and dried. The plating apparatus according to this embodiment is an electroplating apparatus that flows a current through a plating solution to plate a surface of the substrate W with metal. The substrate W as a process target of this embodiment is, for example, a semiconductor package substrate.

As illustrated in FIG. 1, the base 101 is constituted of a plurality of base members 101*a* to 101*h*, and the base members 101*a* to 101*h* are configured to be couplable. Components of the loader/unloader 170A are disposed on the first base member 101*a*, components of the substrate setter 170B are disposed on the second base member 101*b*, components of the processing portion 170C are disposed on the third base member 101*c* to the sixth base member 101*f*, and components of the holder storage 170D are disposed on the seventh base member 101*g* and the eighth base member 101*h*.

The loader/unloader 170A includes a loading stage 105 on which a cassette (not illustrated) housing the substrate W before plating is mounted and an unloading stage 107 on which a cassette (not illustrated) receiving the substrate W plated in the processing portion 170C is mounted. Furthermore, the loader/unloader 170A includes a conveyance device 122 configured of a conveyance robot to convey the substrate W. Note that the substrate W before plating may be directly placed on the loading stage 105, and the substrate W after plating may be directly placed on the unloading stage 107.

The conveyance device 122 accesses the cassette mounted on the loading stage 105 and takes out the substrate W before plating from the cassette, or picks up the substrate W placed on the loading stage 105 and passes the substrate W to the substrate setter 170B. In the substrate setter 170B, the substrate W before plating is set to the substrate holder 11 and the substrate W after plating is taken out from the substrate holder 11.

On the processing portion 170C, a pre-wet tank 126, a pre-soak tank 128, a first rinse tank 130*a*, a blow tank 132, a second rinse tank 130*b*, a first plating tank 10*a*, a second plating tank 10*b*, a third rinse tank 130*c*, and a third plating tank 10*c* are disposed. These tanks 126, 128, 130*a*, 132, 130*b*, 10*a*, 10*b*, 130*c*, and 10*c* are disposed in this order.

In the pre-wet tank 126, as pretreatment preparation, the substrate W is immersed in pure water. In the pre-soak tank 128, an oxidized film on a surface of a conductive layer, such as a seed layer, formed on the surface of the substrate W is removed by etching with a chemical liquid. In the first rinse tank 130*a*, the substrate W after pre-soak is cleaned with a cleaning liquid (for example, pure water).

The substrate W is plated in at least one of plating tanks 10 including the first plating tank 10*a*, the second plating tank 10*b*, and the third plating tank 10*c*. Note that in the embodiment illustrated in FIG. 1, the plating tanks 10 are three, but any given number of the plating tanks 10 may be disposed as another embodiment.

In the second rinse tank 130*b*, the substrate W plated in the first plating tank 10*a* or the second plating tank 10*b* is cleaned with a cleaning liquid (for example, pure water) together with the substrate holder 11. In the third rinse tank 130*c*, the substrate W plated in the third plating tank 10*c* is cleaned with a cleaning liquid (for example, pure water) together with the substrate holder 11. In the blow tank 132, the liquid of the substrate W after cleaning is drained.

The pre-wet tank 126, the pre-soak tank 128, the rinse tanks 130*a* to 130*c*, and the plating tanks 10*a* to 10*c* are process tanks inside of which a process liquid (liquid) can be accumulated. While these process tanks include a plurality of process cells to accumulate the process liquid, the process tanks are not limited to this embodiment, and these process tanks may include a single process cell. At least some of these process tanks may include a single process cell and the other process tanks may include a plurality of process cells.

The plating apparatus further includes a conveyor 140 that conveys the substrate holder 11. The conveyor 140 is configured to be movable between the components of the plating apparatus. The conveyor 140 includes a fixation base 142 that horizontally extends from the substrate setter 170B to the processing portion 170C and a plurality of transporters 141 configured to be movable along the fixation base 142.

These transporters 141 each include a movable portion (not illustrated) that holds the substrate holder 11 to hold the substrate holder 11. The transporters 141 convey the substrate holder 11 between the substrate setter 170B, the holder storage 170D, and the processing portion 170C and further move the substrate holder 11 in the vertical motion together with the substrate W. Examples of a moving mechanism of the transporter 141 include a combination of a motor and a rack and pinion. Note that while the embodiment illustrated in FIG. 1 includes the three transporters, any given number of transporters may be employed as another embodiment.

Figure 2:
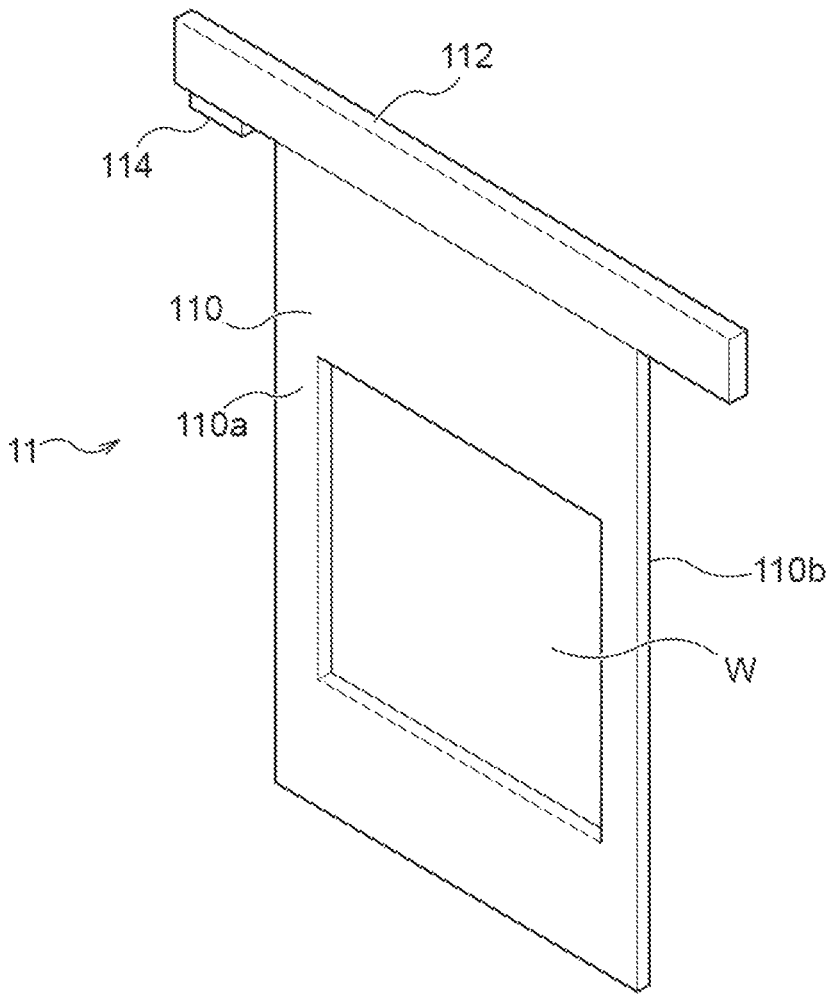
FIG. 2 is a perspective view schematically illustrating one example of a substrate holder used in the plating apparatus according to the one embodiment.

The following describes the configuration of the substrate holder 11 with reference to FIG. 2. FIG. 2 is a perspective view schematically illustrating one example of the substrate holder used in the plating apparatus according to the one embodiment. As illustrated in FIG. 2, the substrate holder 11 includes a main body 110 to which the substrate W is held and an arm 112 disposed on an upper end of the main body 110. The main body 110 includes a first member 110*a* and a second member 110*b*. The substrate W is sandwiched between the first member 110*a* and the second member 110*b*, and thus the substrate holder 11 holds the substrate W. As illustrated in the diagram, the first member 110*a* defines an opening, and the substrate W is held such that a surface to be plated of the surface of the substrate W is exposed. In other words, the first member 110*a* contacts only with the outer peripheral portion of the substrate W to hold the substrate W. The substrate holder 11 is conveyed with the arm 112 held to the transporters 141. While the illustrated substrate holder 11 is to hold the quadrilateral substrate W, the substrate holder 11 is not limited to this, and the substrate holder 11 may hold a circular substrate. In the case, the opening formed in the first member 110*a* also has a circular shape according to the shape of the substrate W. Alternatively, the substrate W can be configured as a substrate having a polygonal shape, such as a hexagonal shape, or another shape. In this case, the opening formed in the first member 110*a* also has a polygonal shape or the like according to the shape of the substrate W.

The main body 110 includes an electric contact in contact with the peripheral edge portion of the substrate W. The electric contact is configured to contact the whole peripheral edge portion of the substrate W. For example, as illustrated in the diagram, the substrate holder 11 holding the quadrangular substrate W includes an electric contact having a quadrangular annular shape so as to contact the peripheral edge portion of the quadrangular substrate W. As another embodiment, the substrate holder 11 holding the circular substrate W includes an electric contact having a circular ring shape so as to contact the peripheral edge portion of the circular substrate W. In one embodiment, when the substrate W is sandwiched between the first member 110*a* and the second member 110*b* of the substrate holder 11 to be held, the electric contact of the substrate holder 11 contacts the conductive layer of the substrate W. The electric contact of the substrate holder 11 is installed in a closed space surrounded by a seal of the substrate holder 11 into which liquid does not enter to avoid the plating solution to contact the electric contact of the substrate holder 11 during the plating process.

When the substrate W held to the substrate holder 11 is immersed in the process liquid in each process tank, the arm 112 is disposed above an arm receiving member (not illustrated) of each process tank. In this embodiment, since the plating tanks 10*a* to 10*c* are electroplating tanks, when a power feeding contact (connector) 114 disposed on the arm 112 contacts an electric contact (not illustrated) disposed on the arm receiving member of the plating tank 10, a current can be supplied from an external power source to the surface of the substrate W.

The plated substrate W is conveyed to the substrate setter 170B by the transporter 141 together with the substrate holder 11 and is taken out from the substrate holder 11 in the substrate setter 170B. This substrate W is conveyed up to the cleaner 170E by the conveyance device 122 and is cleaned and dried in the cleaner 170E. Afterwards, the substrate W is returned to the cassette mounted to the unloading stage 107 or is directly returned to the unloading stage 107 by the conveyance device 122.

Figure 3:
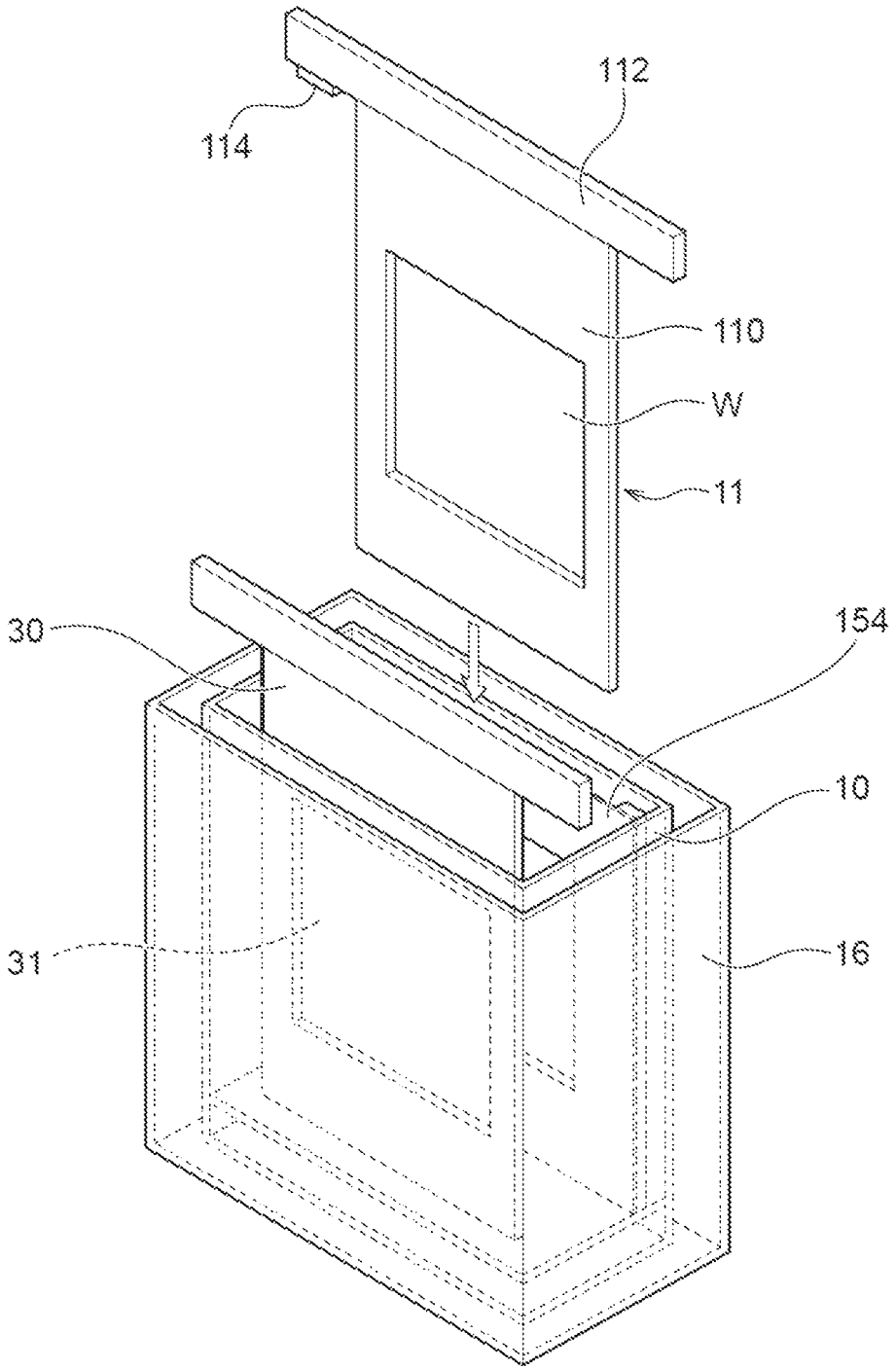
FIG. 3 is a perspective view illustrating a state when the substrate holder to which a substrate is held is disposed in a plating tank according to the one embodiment.

FIG. 3 is a perspective view illustrating a state when the substrate holder 11 to which the substrate W is held is disposed in the plating tank 10 according to the one embodiment. As illustrated in FIG. 3, an anode 31 is disposed in the plating tank 10. The anode 31 can have a shape similar to that of the substrate W as the plating object. When the substrate W has the quadrangular shape, the anode 31 also can have a quadrangular shape, and when the substrate W has the circular shape, the anode 31 also can have a circular shape. Additionally, the anode 31 is held to an anode holder 30. The anode 31 and the anode holder 30 can have any given structure, and, for example, any known structure can be employed.

As illustrated in FIG. 3, the substrate holder 11 to which the substrate W is held is disposed to be opposed to the anode 31 in the plating tank 10. When the substrate holder 11 is disposed in the plating tank 10, the surface of the substrate W faces the anode 31. As illustrated in FIG. 3, between the substrate holder 11 and the anode holder 30, a shielding plate 154 to restrict or adjust an electric field formed between the substrate W and the anode 31 is disposed. Note that, in one embodiment, between the anode holder 30 and the shielding plate 154, a paddle to stir the plating solution in the plating tank 10 may be disposed. In one embodiment, as illustrated in FIG. 3, the plating tank 10 includes an outer tank 16 to receive the plating solution overflown from the plating tank 10. Note that, for clarification of the illustration, a part of the plating tank 10, the outer tank 16, and the anode holder 30 are transparently illustrated in FIG. 3.

Figure 4:
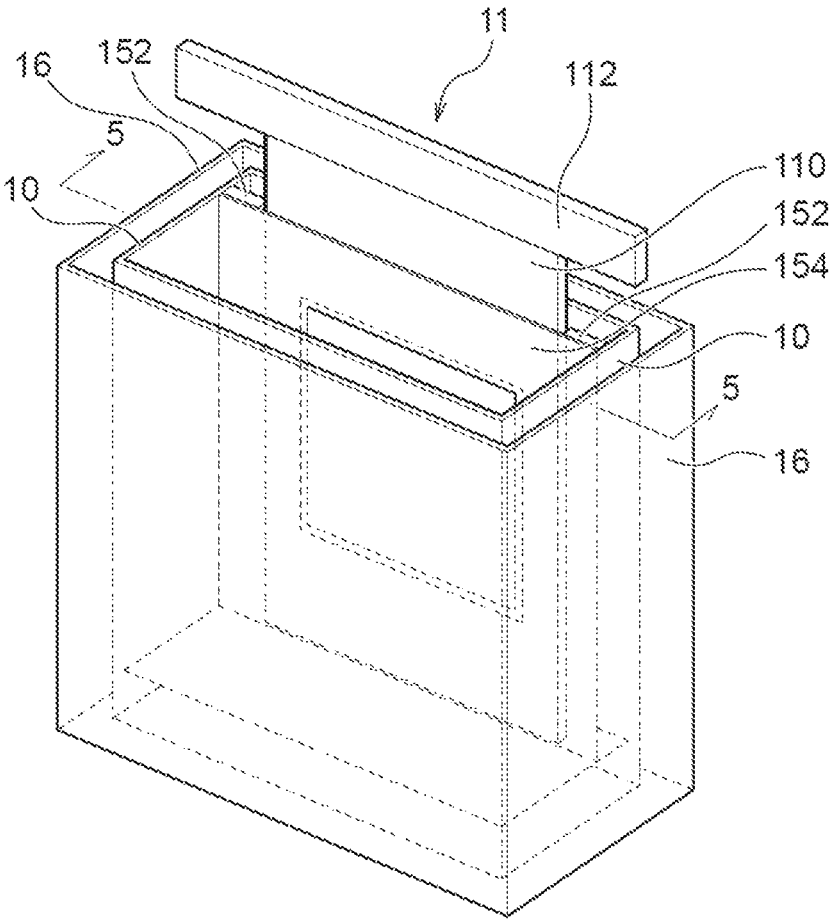
FIG. 4 is a drawing illustrating the plating tank in a state where the substrate holder is disposed according to the one embodiment.
Figure 5:
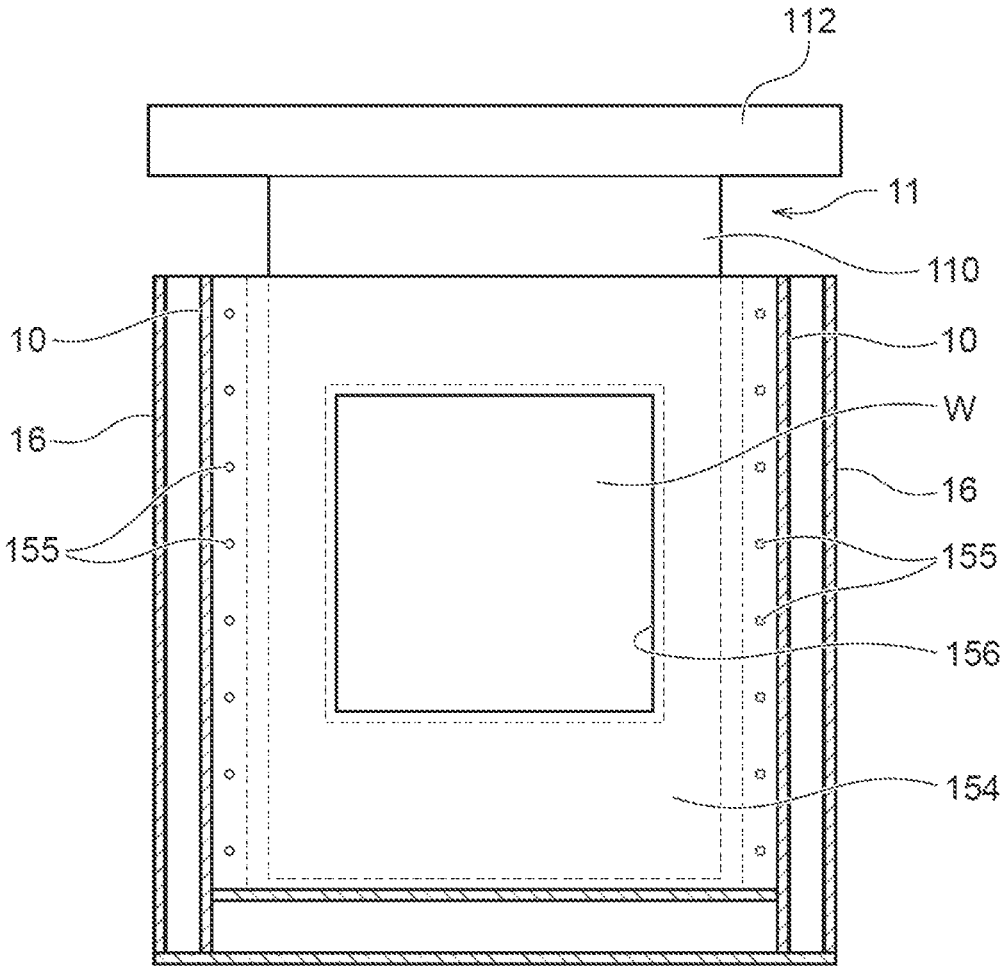
FIG. 5 is a drawing when viewed from a direction of an arrow 5 in FIG. 4.

FIG. 4 is a drawing illustrating the plating tank 10 in a state where the substrate holder 11 is disposed according to the one embodiment. For clarification of the illustration, FIG. 4 omits the illustration of the anode holder 30 and the anode 31. FIG. 5 is a drawing when viewed from a direction of an arrow 5 in FIG. 4. That is, FIG. 5 is a drawing viewing the shielding plate 154 from the front surface. As illustrated in FIG. 4 and FIG. 5, the shielding plate 154 defines an opening 156. The opening 156 of the shielding plate 154 has a shape corresponding to the shapes of the substrate W as the plating object and the opening defined by the main body 110 of the substrate holder 11. For example, like the embodiment illustrated in the drawing, when the substrate W has the quadrangular shape and the opening of the main body 110 of the substrate holder 11 has the quadrangular shape, the opening 156 of the shielding plate 154 also has a quadrangular shape. Additionally, when the substrate W has the circular shape and the opening of the main body 110 of the substrate holder 11 has the circular shape, the opening 156 of the shielding plate 154 also has the circular shape.

As illustrated in FIG. 5, an opening area of the opening 156 of the shielding plate 154 is smaller than that of the opening of the main body 110 of the substrate holder 11. More specifically, as illustrated in FIG. 5, when the shielding plate 154 and the substrate holder 11 are viewed from the anode 31 side, dimensions and locations of the opening 156 of the shielding plate 154 and the opening of the main body 110 of the substrate holder 11 are determined such that a part of the outer periphery of the substrate W held to the substrate holder 11 overlaps with the shielding plate 154.

Figure 6:
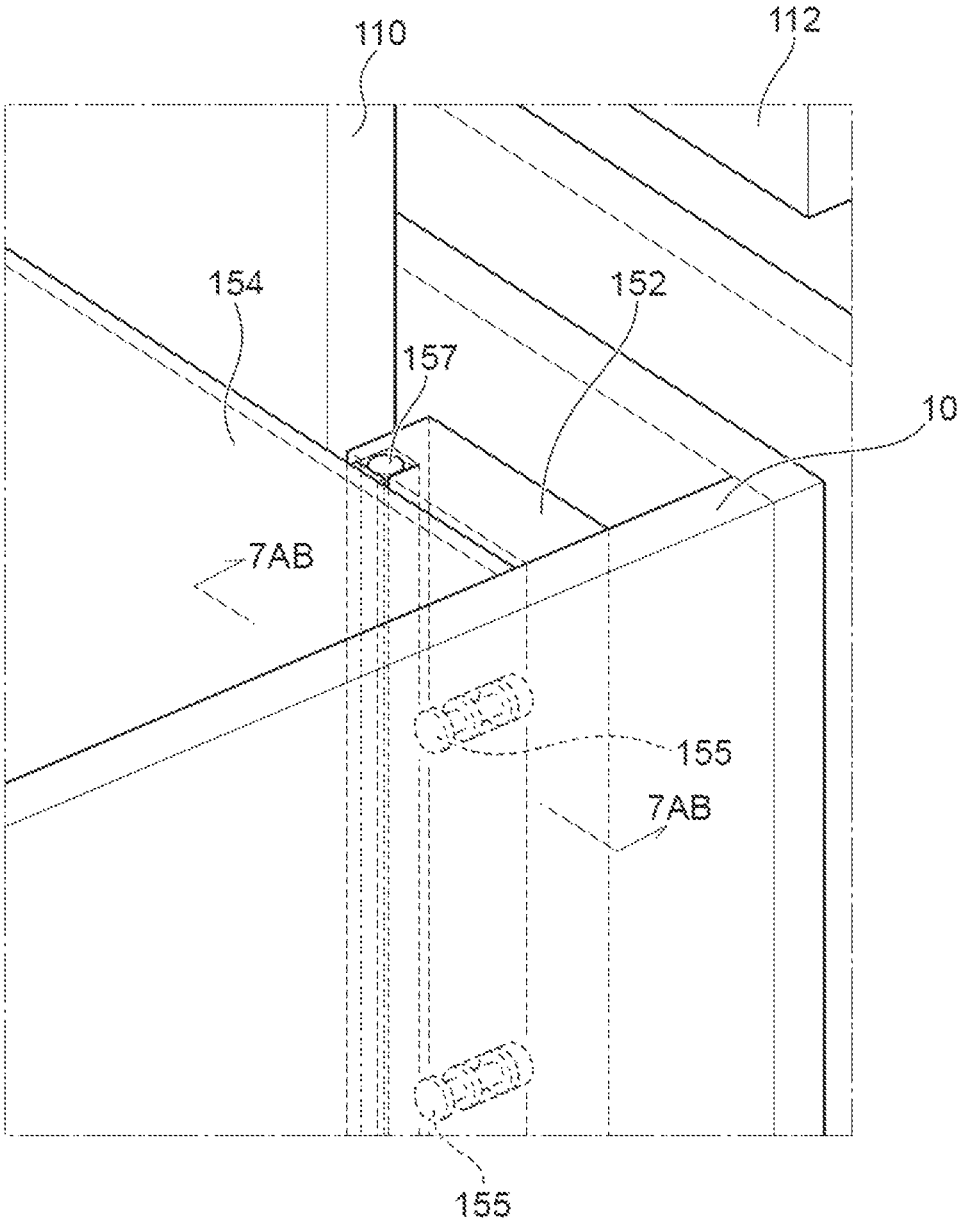
FIG. 6 is a drawing illustrating an enlarged periphery of a moving mechanism of a shielding plate illustrated in FIG. 4.

In one embodiment, the shielding plate 154 includes a moving mechanism for movement in a direction of approaching the substrate holder 11 and a direction away from the substrate holder. FIG. 6 is a drawing illustrating an enlarged periphery of the moving mechanism of the shielding plate 154 illustrated in FIG. 4. In the embodiment illustrated in the drawing, the moving mechanism includes supporting members 152 disposed on inner side surfaces of the plating tank 10. As illustrated in FIG. 4 and FIG. 6, the supporting member 152 according to the one embodiment can be configured as a plate-shaped member extending from the open upper end to the lower end with the bottom surface of the plating tank 10, on the side surface of the plating tank 10. As illustrated in FIG. 4, the supporting members 152 are disposed on the inner side surfaces on both sides of the plating tank 10. As illustrated in the diagram, the shielding plate 154 is supported by the supporting members 152. As illustrated in the diagram, the shielding plate 154 according to the one embodiment is disposed on one surface of the supporting members 152. In the state supported by the supporting members 152, the shielding plate 154 is movable in a direction perpendicular to the surface of the substrate W disposed on the substrate holder 11 in the plating tank 10.

In one embodiment, as illustrated in FIG. 6, a fluid spring 157 is disposed in the supporting member 152. The fluid spring 157 is disposed on a surface on the shielding plate 154 side supported by the supporting member 152. The fluid spring 157 extends across the overall height of the supporting member 152. As illustrated in FIG. 6, the fluid spring 157 is disposed in a depressed portion formed in the surface on the shielding plate 154 side of the supporting member 152. The fluid spring 157 is coupled to the supporting member 152 and the shielding plate 154. The fluid spring 157 is connected to a fluid flow passage and a fluid source (not illustrated). Supplying fluid to the fluid spring 157 expands the fluid spring 157 and moves the shielding plate 154 in a direction away from the surface of the substrate holder 11. Additionally, discharging fluid from the fluid spring 157 contracts the fluid spring 157 and moves the shielding plate 154 toward the surface of the substrate holder 11. Note that "the surface of the substrate holder" refers to the surface of the substrate holder parallel to the surface to be plated of the substrate held to the substrate holder. In one embodiment, the fluid spring 157 can be an air spring. In one embodiment, instead of the fluid spring 157, a cam mechanism or the like may move the shielding plate 154. Note that it is only necessary that the fluid spring 157 is disposed so as to ensure moving the shielding plate 154 as described above, and therefore the fluid spring 157 is not necessary to extend across the overall height of the shielding plate 154. For example, a plurality of the fluid springs 157 may be disposed in the height direction of the shielding plate 154 at predetermined intervals.

Figure 7A:
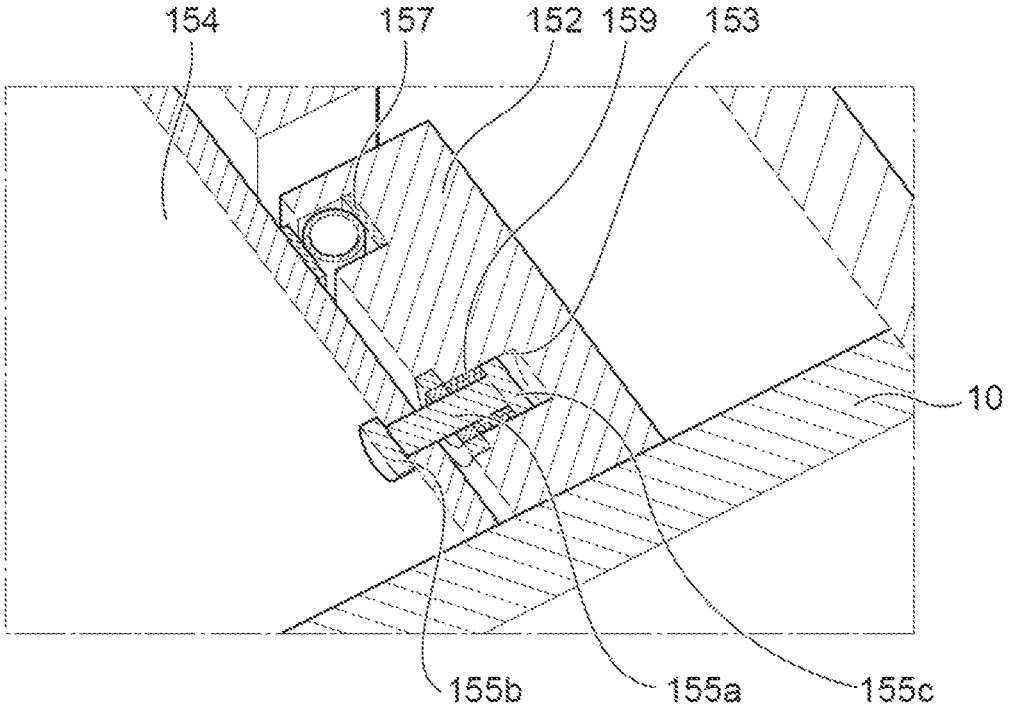
FIG. 7A is a partial cross-sectional view taken along an arrow 7AB in FIG. 6.
Figure 7B:
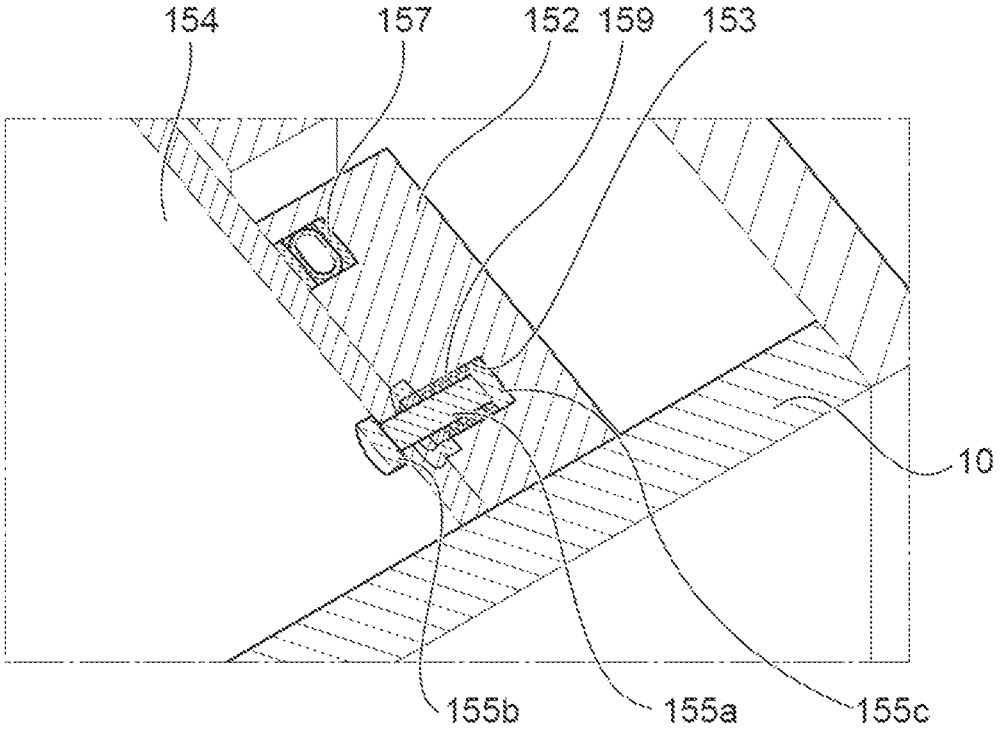
FIG. 7B is a partial cross-sectional view taken along the arrow 7AB in FIG. 6.

In one embodiment, as illustrated in FIG. 5 and FIG. 6, the supporting member 152 and the shielding plate 154 are coupled with coupling pins 155. In the embodiment illustrated in FIG. 6, a plurality of the coupling pins 155 are disposed in the height direction of the supporting member 152. FIG. 7A and FIG. 7B are partial cross-sectional views taken along an arrow 7AB in FIG. 6. As illustrated in FIG. 7A and FIG. 7B, the coupling pin 155 includes a shaft 155*a* and heads 155*b* and 155*c* positioned on both ends of the shaft 155*a*. The shaft 155*a* is a columnar member. The heads 155*b* and 155*c* are circular-plate shaped or columnar members having radiuses larger than that of the shaft 155*a*. As illustrated in FIG. 7A and FIG. 7B, the one head 155*b* is disposed on a surface on the opposite side of the substrate holder 11 of the shielding plate 154, and the shaft 155*a* penetrates the shielding plate 154 and extends to a depressed portion 153 formed in the supporting member 152. The head 155*c* on the opposite side is disposed in the depressed portion 153 fowled in the supporting member 152. As illustrated in FIG. 7A and FIG. 7B, a spring 159, for example, a coil spring is disposed in the depressed portion 153 of the supporting member 152 so as to surround the shaft 155*a*. The spring 159 is disposed to bias the coupling pin 155 in a direction of introducing into the depressed portion 153.

Supplying the fluid spring 157 with fluid expands the fluid spring 157 and overcomes the biasing force from the spring 159 to move the shielding plate 154 in the direction away from the substrate holder 11. On the other hand, discharging fluid from the fluid spring 157 contracts the fluid spring 157, and the biasing force from the spring 159 moves the shielding plate 154 toward the side surface of the substrate holder 11. FIG. 7A illustrates the state where the fluid spring 157 expands and the shielding plate 154 is at the position away from the substrate holder 11. FIG. 7B illustrates the state where the fluid spring 157 contracts and the shielding plate 154 is at the position approaching the substrate holder 11.

Note that, in one embodiment, the above-described supporting members 152, fluid spring 157, coupling pins 155, and spring 159 may be disposed on the surface on the opposite side of the shielding plate 154 such that the shielding plate 154 approaches the substrate holder 11 when the fluid spring 157 expands. In the embodiment illustrated in FIG. 7A and FIG. 7B, without the use of the coupling pins 155 or the spring 159, the expansion and the contraction of the fluid spring 157 may move the shielding plate 154 as described above. Further, in the embodiment illustrated in 7A and FIG. 7B, in addition to the actions by the expansion and the contraction of the fluid spring 157, actions by the coupling pins 155 and the spring 159 may move the shielding plate 154 as described above.

The plating apparatus according to the above-described embodiment allows the shielding plate 154 to move in the direction of approaching the substrate W and the direction away from the substrate W. The substrate holder 11 is disposed in the plating tank 10 such that the shielding plate 154 is at the position far from the substrate holder 11. This allows reducing a risk of collision of the substrate holder 11 with the shielding plate 154 when the substrate holder 11 is disposed in the plating tank 10. Additionally, after the substrate holder 11 is disposed in the plating tank 10, the shielding plate 154 is moved in the direction of approaching the substrate holder 11. This allows approximating the shielding plate 154 to the substrate W. In one embodiment, the shielding plate 154 can be moved toward the substrate holder 11 until in contact with the substrate holder 11. Moreover, in one embodiment, a sealing member may be disposed on a part where the shielding plate 154 contacts the substrate holder 11. The sealing member may be disposed in any of the shielding plate 154 and the substrate holder 11. Approximating the shielding plate 154 to the substrate W held to the substrate holder 11 allows adjusting an electric potential distribution near the outer periphery of the substrate W. Around the outer periphery of the substrate W is close to the electric contact of the substrate holder 11, and therefore the electric potential is likely to concentrate. Therefore, the outer peripheral part of the substrate tends to increase its film thickness in the plating process. The plating apparatus according to the embodiment of this disclosure allows adjusting the electric potential distribution of the outer peripheral portion of the substrate with the shielding plate 154 positioned extremely close to the substrate W. Further, in one embodiment, a distance between the shielding plate 154 and the substrate holder 11 may be changed during the plating process. For example, the shielding plate 154 may be moved to be far away from the substrate holder 11 during the plating process. In one embodiment, the controller 103 in the plating apparatus controls the moving mechanism of the shielding plate 154. For example, by controlling a pressure of the fluid supplied to the fluid spring 157 and an operation of the cam mechanism, the position of the shielding plate 154 can be controlled during the plating process.

When the plating process is terminated, after the shielding plate 154 is moved in the direction away from the substrate holder 11, the substrate holder 11 is pulled out of the plating tank 10, thus ensuring reducing a risk that the substrate holder 11 contacts the shielding plate 154.

Furthermore, since the plating apparatus according to the embodiment of this disclosure does not include a regulation ring to adjust the electric potential distribution of the substrate holder 11, the plating apparatus does not have a structure projecting out to the front surface of the substrate holder 11. In a case where a regulation ring having an opening smaller than the held substrate to some extent is disposed in the substrate holder, a pocket-shaped region is formed on the front surface of the substrate holder. However, with the embodiment of this disclosure, the pocket-shaped region can be eliminated. This reduces a risk that air bubble remains in the substrate holder 11 when the substrate holder 11 is immersed in the plating solution. Additionally, this reduces a risk that the plating solution remains the inside of the intricated structure of the substrate holder 11 when the substrate holder 11 is pulled out of the plating solution.

The embodiments of the present invention have been described above based on some examples in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

From the above-described embodiments, at least the following technical ideas are obtained.

[Configuration 1] According to a configuration 1, there is provided a plating apparatus for performing a plating process on a substrate. The plating apparatus includes a substrate holder, a shielding plate, and a moving mechanism. The substrate holder holds the substrate. The shielding plate is disposed adjacent to the substrate holder. The moving mechanism moves the shielding plate in a direction of approaching the substrate holder and a direction away from the substrate holder. The shielding plate is moved to the substrate holder by the moving mechanism to be contactable with the substrate holder.

[Configuration 2] According to a configuration 2, in the plating apparatus according to the configuration 1, the shielding plate includes a sealing member contactable with the substrate holder.

[Configuration 3] According to a configuration 3, in the plating apparatus according to the configuration 1 or the configuration 2, the substrate holder includes a sealing member contactable with the shielding plate.

Configuration [4] According to a configuration 4, in the plating apparatus according to any one of the configurations of the configuration 1 to the configuration 3, the substrate holder defines an opening from which a part of the held substrate is exposed. The shielding plate defines an opening. The opening of the shielding plate has a dimension smaller than a dimension of the opening of the substrate holder.

[Configuration 5] According to a configuration 5, in the plating apparatus according to any one of the configurations of the configuration 1 to the configuration 4, the moving mechanism includes a fluid spring.

[Configuration 6] A configuration 6, in the plating apparatus according to any one of the configurations of the configuration 1 to the configuration 5, further includes a plating tank configured to receive the substrate holder and the shielding plate.

[Configuration 7] According to a configuration 7, in the plating apparatus according to the configuration 6, the plating tank includes a supporting member that supports the shielding plate.

[Configuration 8] According to a configuration 8, in the plating apparatus according to any one of the configurations of the configuration 1 to the configuration 7, the moving mechanism is configured to change a distance between the substrate holder and the shielding plate during the plating process.

[Configuration 9] According to a configuration 9, in the plating apparatus according the configuration 8, further includes a controller configured to control an operation of the moving mechanism.

REFERENCE SIGNS LIST

10 . . . plating tank
11 . . . substrate holder
16 . . . outer tank
30 . . . anode holder
31 . . . anode
110 . . . main body
112 . . . arm
114 . . . electric contact
152 . . . supporting member
153 . . . depressed portion
154 . . . shielding plate
155 . . . coupling pin
156 . . . opening
157 . . . fluid spring
155*a* . . . shaft
155*b* . . . head
155*c* . . . head
W . . . substrate

What is claimed is:

1. A plating apparatus for performing a plating process on a substrate, the plating apparatus comprising:
a substrate holder for holding the substrate;
a shielding plate disposed adjacent to the substrate holder;
a plating tank configured to receive the substrate holder and the shielding plate; and
a moving mechanism for moving the shielding plate in a direction of approaching the substrate holder and a direction away from the substrate holder, wherein
the shielding plate is moved to the substrate holder by the moving mechanism to be contactable with the substrate holder,
the substrate holder defines an opening from which a part of the held substrate is exposed, and
the shielding plate defines an opening, and the opening of the shielding plate has a dimension smaller than a dimension of the opening of the substrate holder,
the moving mechanism includes a fluid spring,
the plating tank includes a supporting member for supporting the shielding plate,
the supporting member is a plate-shaped member extending from an open upper end to a lower end of the plating tank,
the fluid spring is coupled to the supporting member and the shielding plate.

2. The plating apparatus according to claim 1, wherein
the shielding plate includes a sealing member contactable with the substrate holder.

3. The plating apparatus according to claim 1, wherein
the substrate holder includes a sealing member contactable with the shielding plate.

4. The plating apparatus according to claim 1, wherein
the moving mechanism is configured to change a distance between the substrate holder and the shielding plate during the plating process.

5. The plating apparatus according to claim 4, further comprising
a controller configured to control an operation of the moving mechanism.

6. The plating apparatus according to claim 1, wherein
the fluid spring extends across the overall height of the supporting member.

* * * * *